US007591347B2

(12) United States Patent
Hikita

(10) Patent No.: US 7,591,347 B2
(45) Date of Patent: Sep. 22, 2009

(54) CONTROL METHOD AND SYSTEM FOR ELEVATOR

(75) Inventor: Shiro Hikita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 359 days.

(21) Appl. No.: 11/660,661

(22) PCT Filed: Jan. 24, 2006

(86) PCT No.: PCT/JP2006/001004

§ 371 (c)(1),
(2), (4) Date: Feb. 21, 2007

(87) PCT Pub. No.: WO2006/082729

PCT Pub. Date: Aug. 10, 2006

(65) Prior Publication Data

US 2007/0272496 A1 Nov. 29, 2007

(30) Foreign Application Priority Data

Feb. 2, 2005 (JP) ..... 2005-026694

(51) Int. Cl.
*B66B 1/18* (2006.01)

(52) U.S. Cl. ..... 187/382; 187/247

(58) Field of Classification Search ..... 187/247, 187/248, 380–388
See application file for complete search history.

(56) References Cited

U.S. PATENT DOCUMENTS

| | | | | |
|---|---|---|---|---|
| 5,024,295 | A * | 6/1991 | Thangavelu | 187/382 |
| 5,300,739 | A * | 4/1994 | Bittar | 187/385 |
| 6,364,065 | B1 * | 4/2002 | Hikita | 187/382 |
| 7,392,884 | B2 * | 7/2008 | Hikita | 187/249 |
| 7,510,054 | B2 * | 3/2009 | Bahjat et al. | 187/382 |

FOREIGN PATENT DOCUMENTS

| | | |
|---|---|---|
| JP | 01-261176 | 10/1989 |
| JP | 02-127372 | 5/1990 |
| JP | 06-271213 | 9/1994 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

An operation control method of plural elevators working between many floors is constructed so that a risk floor having a high probability that a long wait occurs is selected from among floors on which a platform call is not generated when a platform call is newly generated, assuming that along with the newly generated platform call a platform call is generated on the risk floor, allocation evaluations are made on the cases of allocating respective elevators to render services to these calls, an elevator to respond to the new platform call is decided based on the allocation evaluation result, and the plural elevators are controlled to be operated based on this decision.

5 Claims, 4 Drawing Sheets

CONTROL METHOD AND SYSTEM FOR ELEVATOR

TECHNICAL FIELD

This invention relates to a control method and a control apparatus of plural juxtaposed elevators for working between many floors of the inside of, for example, a building, and particularly to a control method and a control apparatus of managing elevator groups management in quick response to momentarily varying intra-building traffic.

BACKGROUND ART

When plural elevators for working between many floors of the inside of, for example, a building are juxtaposed, group management control is generally performed in order to manage and control their elevators, and there is known a call allocation control as one of such group management control. In this control method, immediately after a platform call is registered, an elevator (hereinafter represented as a cage) to render a service is selected and allocated to the platform call and thereby the cage (hereinafter represented as an allocated cage) to make a response is decided. By properly performing this call allocation, transport efficiency as the whole of the building can be improved.

Here, passengers randomly come to an elevator platform, so that the passengers come at unexpected timing, with the result that a long wait may occur. One of the important objects of the group management control is to decrease such a long wait.

As a group management control apparatus of elevators intended to decrease this long wait, the following approaches have been proposed conventionally.

That is, for example, as shown in JP-A-6-271213 (hereinafter referred to as Patent Reference 1), there is an approach in which an evaluation target of call allocation is not limited to one hall call and plural sets of "collective call allocation plans" capable of simultaneously allocating each of the elevators to each of the plural hall calls are prepared, multilateral examination and evaluation are given to each of the plans to select an optimum plan, and a command is issued.

Also, as shown in Japanese Patent No.2560403 (hereinafter referred to as Patent Reference 2), there is an approach in which the present and future traffic states at the time of allocating each of the elevators to a hall call are grasped as fuzzy amounts, a rule most suitable for each of the states is selected online and a proper cage allocation is selected by the selected rule.

Patent Reference 1: JP-A-6-271213

Patent Reference 2: Japanese Patent No.2560403

DISCLOSURE OF THE INVENTION

Problems that the Invention is to Solve

However, in the art disclosed in Patent Reference 1 described above, when a long wait occurs or is predicted after call allocation is performed once, the allocation is reviewed and when a platform call is newly generated, a future long wait is not prevented. As a result, the art is unsuitable for a system for immediately turning on the light to indicate a service elevator simultaneously with generation of a hall call, that is, a system for immediately deciding an allocated cage and giving a passenger a forecast, adopted in many group management systems. In addition, this forecast system is adopted for the purpose of reducing frustrations such as annoyance of waiting passengers at a hall caused by uncertainty over which elevator arrives.

Also, the art disclosed in Patent Reference 2 described above discloses only ruling of a control rule, and does not refer to quantitative evaluation of risk of occurrence of a long wait in a floor on which a platform call has not been generated yet.

The invention solves the problems of the conventional arts as described above, and an object of the invention is to provide a control method and a control apparatus of elevators in which efficient group management control can be performed by minimizing occurrence of a long wait.

Means for Solving the Problems

A elevator control method for controlling plural juxtaposed elevators for working between many floors according to the invention includes a step in which risk floor selection means selects at least one of the risk floors having a high probability that a long wait occurs from among floors on which a platform call is not generated when a platform call is newly generated, a step of assuming that along with the newly generated platform call a platform call is generated on the selected risk floor and making allocation evaluation of the case of respectively allocating elevators to render services to these calls, a step in which allocation means decides an elevator to respond to the new platform call based on the allocation evaluation result, and a step in which operation control means operates and controls the plural elevators based on the decision.

Also, an elevator control apparatus according to the invention includes plural respective elevator box control devices for respectively controlling plural juxtaposed elevators for working between many floors and a group management control device for managing and controlling the plural respective elevator box control devices, wherein the group management control device comprises risk floor selection means for selecting at least one of the risk floors having a high probability that a long wait occurs from among floors on which a platform call is not generated when a platform call is newly generated, allocation evaluation means for assuming that along with the newly generated platform call a platform call is generated on the risk floor and making allocation evaluation of the case of respectively allocating elevators to render services to these calls, allocation means for deciding an elevator to respond to the new platform call based on the evaluation result of the allocation evaluation means, and operation control means for operating and controlling the plural elevators by managing and controlling the plural respective elevator box control devices based on the allocation decision of the allocation means.

Effect of the Invention

In accordance with the control method and the control apparatus of elevators according to the invention, when a platform call is newly generated at least one of the risk floors having a high probability that a long wait occurs is selected from among floors on which a platform call is not generated, assuming that a platform call is generated on the risk floor along with the newly generated call, allocation evaluations are made on the cases of allocating the respective cages to these calls, and a cage is decided to be allocated to the floor on which the platform call is newly generated based on this evaluation result, so that an effect of decreasing a long wait and improving transport efficiency is obtained.

BEST MODE FOR CARRYING OUT THE INVENTION

First Embodiment

A first embodiment of the invention will be described below using the drawings. FIG. 1 is a block diagram showing the entire functional configuration of a control apparatus of an elevator in a first embodiment of the invention.

In FIG. 1, a control apparatus A of an elevator comprises a group management control device 1 for efficiently managing and controlling plural cages, plural respective elevator box control devices 2 for controlling respective cages, hall lanterns 3 for performing forecast display of allocation to a platform call and guidance display of arrival of each of the cages, UP/DN type platform buttons 4, and platform stations 5 for controlling platform devices such as the hall lanterns 3 or the platform buttons 4. In addition, a door of the elevator is shown by numeral 6.

Also, the group management control device 1 of FIG. 1 includes communication means 1A for conducting information communication with the respective elevator box control devices 2 etc., risk floor selection means 1B for selecting at least one of the risk floors having a high possibility that a long wait occurs from among floors on which a platform call is not generated when a platform call is newly generated, predictive calculation means 1C for doing predictive calculation of how many seconds it takes for each of the cages to reach when the each of the cages is allocated to the risk floor platform call selected by the risk floor selection means 1B or the new platform call, allocation evaluation means 1D for assuming that along with the new platform call a platform call is generated in the selected risk floor and comprehensively making allocation evaluation of the case of respectively allocating the each cage to these calls, allocation means 1E for deciding a cage allocated to the new platform call based on the evaluation result of the allocation evaluation means 1D, and operation control means 1F for generally operating and controlling the each cage based on the allocation result etc. of the allocation means 1E, and each of these means 1A to 1F is constructed by software on a microcomputer.

Next, the operation of the control apparatus of the elevator in the first embodiment of the invention will be described using FIGS. 2 and 3. FIG. 2 is a flowchart showing the outline of an allocated cage decision procedure to a new platform call in the first embodiment of the invention, and FIG. 3 is a diagram describing the concept of a risk floor.

When a platform call is newly generated in step S200 of FIG. 2, a candidate for a risk floor is first selected in step S201. Selection of this risk floor candidate will be described using FIG. 3.

FIG. 3 shows a state in which juxtaposed cages of #1 to #4 move between the first floor and the tenth floor, and an example of this diagram shows a state in which the cage of #1 is traveling on the fifth floor in the UP direction and similarly the cage of #2 is traveling on the seventh floor in the Down direction and the cage of #3 is traveling on the fourth floor in the UP direction, respectively. Also, it is shown that the cage of #4 is in a door closed standby state on the first floor. The case that a platform call in the Down direction is newly generated on the ninth floor in such a situation is assumed.

An arbitrary number of risk floor candidates may be properly selected and basically, the farthest floor (the so-called back floor) for each cage to reach is selected judging from the moving direction and a position of each cage at a point of time when the new platform call is generated. In the example of FIG. 3, the running cages of #1 to #3 in travel select respective back floors. That is, the cage of #1 selects the fourth floor in the UP direction, the cage of #2 selects the eighth floor in the Down direction and the cage of #3 selects the third floor in the UP direction, respectively.

These back floors are the farthest floors for the respective cages to reach and the floors of a high possibility that a long wait occurs when the respective cages responds to a newly platform call generated on these floors.

Also, the cage of #4 is in a door-closed standby state, and will travel in the UP direction when the cage is allocated to a new platform call. Therefore, the cage of #4 is pseudoly regarded to be in the UP direction of the first floor and Down of the second floor which is the floor farthest from here is selected as a risk floor candidate.

When each of the risk floor candidates is selected as described above, in step S202 and step S203 of FIG. 2, with respect to each of the risk floor candidates, the case of tentatively generating a platform call the each floor is assumed and predictive calculation for computing prediction of arrival at an assumed platform call floor of the case of allocating each of the cages to a platform call of each of the risk floor candidates and evaluated value calculation based on its arrival predictive calculation result are done respectively.

The arrival predictive calculation is first done in step S202. This predictive calculation computes how many seconds it takes for each of the cages to arrive at each of the floors. This procedure is disclosed in, for example, JP-A-54-102745 (Patent Reference 3) and has been widely implemented in group management control conventionally, so that its procedure will be herein described simply.

That is, in the following manner, an arrival predicted time table creation program is previously created and arrival predicted time calculated by periodically executing this program is stored and when a hall call is generated, this stored arrival predicted time-is fetched.

FIG. 4 is a flowchart of an arrival predicted time table creation program and in step S400 of this FIG. 4, data of a cage state (a cage direction, a cage position, door opening and closing, a travel situation, etc.), a cage call and a hall call necessary to create the arrival predicted time table are captured in predetermined memory.

Next, one is set in an index register (step S401) and then, an initial value varying by a cage state is set in a time table T so that the time table T is set in an arrival predicted time table (step S402) . For example, since the initial value is different between when a cage is under suspension and when Lt is traveling, it is set to be smaller when the cargo is traveling than when the cage is under suspension.

When processing of step S402 ends, the floor is then incremented by one (step S403) to be determined whether or not the floor reaches a cage position (step S404) When the floor does not reach the cage position, the time (for example, two seconds) necessary to travel one floor is added to the time table T (step S405).

Then, this time table T is set in the arrival predicted time table (step S406). Then, it is determined whether or not there is a cage call or an allocated hall call in the floor in concern (step S407), and when there are such calls, processing of step S408 is performed. That is, the time (for example, ten seconds) necessary to stop at one floor is added to the time table T. When there is not the cage call or the allocated hall call in step S407, it jumps to step S403 and similar processing is repeated.

When the floor reaches the cage position in step S404, an arrival predicted time table is similarly created with respect to the next cage and when an arrival predicted time table is made for all the cages, this program ends. As described above, the arrival predicted time tables are created by scanning all the floors, all the directions and all the cages.

Returning to the flowchart of FIG. 2, in step S203, evaluated value calculation is done based on the calculation result of the arrival predicted time of step S202. This evaluated value computation is performed by obtaining, for example, an evaluation function value as shown in the following formula.

$$J(I)=\Sigma wi\times fi(xi) \quad \text{[Mathematical Formula 1]}$$

J(I): An evaluated value when cage No. I is allocated to a specified risk floor candidate wi: Wait xi: Various evaluated values such as wait time Then, in step S204, a risk floor is selected from among the risk floor candidates selected in step S201 based on the evaluated value computation result performed to step S203.

Here, as shown in the following formula, a cage in which an evaluated value becomes best for each of the risk floor candidates r (the minimum evaluated value is herein considered as best) and an evaluated value of the case of allocating its cage are first fetched and this value is set as an evaluated value Vr of the risk floor candidate r.

$$Vr=\min J(I) \quad \text{[Mathematical Formula 2]}$$

J(I): An evaluated value when cage No. I is allocated a specified risk floor candidate r Next, as shown in the following formula, a value becoming the maximum value is fetched from among the evaluated values Vr obtained by the procedure described above and a risk floor candidate corresponding to this value is selected as a risk floor R.

$$V(R)=\max Vr \quad \text{[Mathematical Formula 3]}$$

The procedure described above means that if a platform call is generated, a floor having a large evaluation function value and the greatest influence on intra-building transport efficiency, that is, a floor which tends to cause a long wait is selected as a risk floor.

When the risk floor is selected as described above, a cage allocated to a new platform call is decided by a procedure subsequent to step S205.

First, predictive calculation of the case of allocating each of the cages to a new platform call and evaluation calculation are done in step S205 and step S206. The procedure of step S205 is basically equal to the procedure of step S202, so that detailed description is omitted.

Also, the evaluated value computation procedure of step S206 is substantially similar to the procedure of step S203, and as shown in the following formula, assuming that a new platform call and a platform call on the risk floor are simultaneously generated, an evaluated value is obtained in the case of allocating each of the cages to each of the platform calls.

$$J(i,j)=Jn(i)+W\times Jr(j) \quad \text{[Mathematical Formula 4]}$$

J(i,j): An evaluated value when cage No. i is allocated to the new platform call and cage No. j is allocated to the risk floor Jn(i) : An evaluated value when cage No. i is allocated to the new platform call Jr(j) : An evaluated value when cage No. j is allocated to the risk floor W: Wait When the evaluated values in all the cases are computed is described above, a cage allocated to the new platform call is decided in step S207.

For this purpose, a combination of allocated cages (i, j) having the best evaluation function value J(i,j) is first fetched and from the combination of allocated cages (i,j), cage No. i is finally decided to be allocated to the new platform call.

By being constructed as described above, after evaluations of floors having a great influence on intra-building transport efficiency if a platform call is generated from these floors on which a platform call is not generated yet, that is, floors which tend to cause a long wait are made, evaluation of the new platform call and decision of a cage to be allocated can be made.

When the cage to be allocated is decided in this manner, in step S208, an allocation command is issued to the allocated cage and operation control of each of the cages is performed based on this command.

In addition, in each of the procedures described above, steps S201 and S204 are performed by the risk floor selection means 1B, steps S202 and S205 are performed by the predictive calculation means 1C, S203 and S206 are performed by the allocation evaluation means 1D, S207 is performed by the allocation means 1E, and S208 is performed by the operation control means 1F, respectively.

As described above, according to this first embodiment, an effect of decreasing a long wait and improving transport efficiency is obtained.

INDUSTRIAL APPLICABILITY

A control method and a control apparatus of elevators according to the invention can perform efficient control by minimizing occurrence of a long wait by call allocation control which is one of group management control for managing and controlling plural elevators when plural elevators are juxtaposed, and have great industrial applicability.

BRIEF DESCRIPTION OF THE DRAWINGS

FIG. 1 is a block diagram showing the entire functional configuration of a control apparatus of elevators in a first embodiment of the invention.

FIG. 2 is an action flowchart diagram in the first embodiment of the invention.

FIG. 3 is a diagram describing an allocation action in the first embodiment of the invention.

FIG. 4 is a flowchart diagram of an arrival predicted time table creation program.

Figure 1:
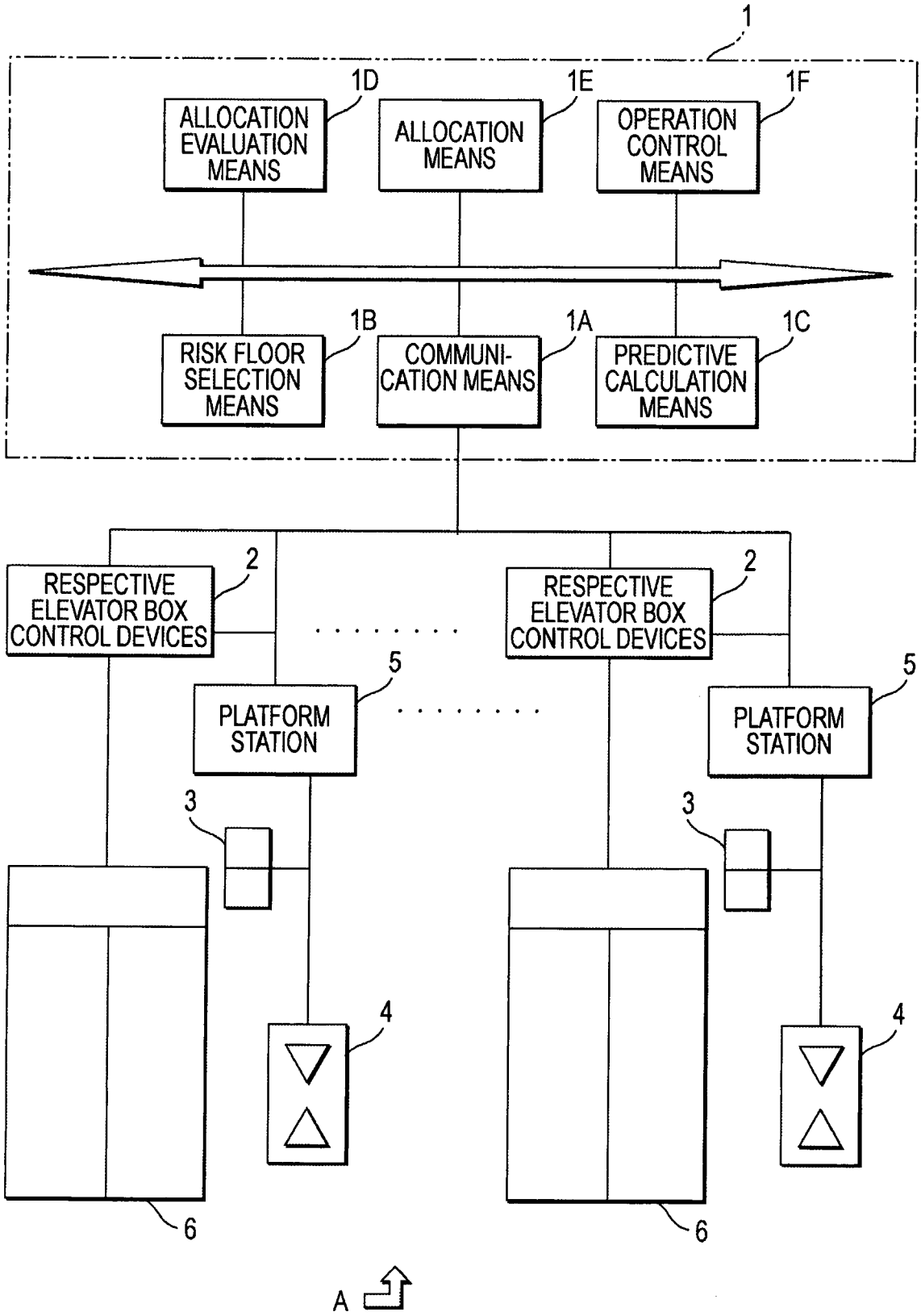
[FIG. 1]
Figure 2:
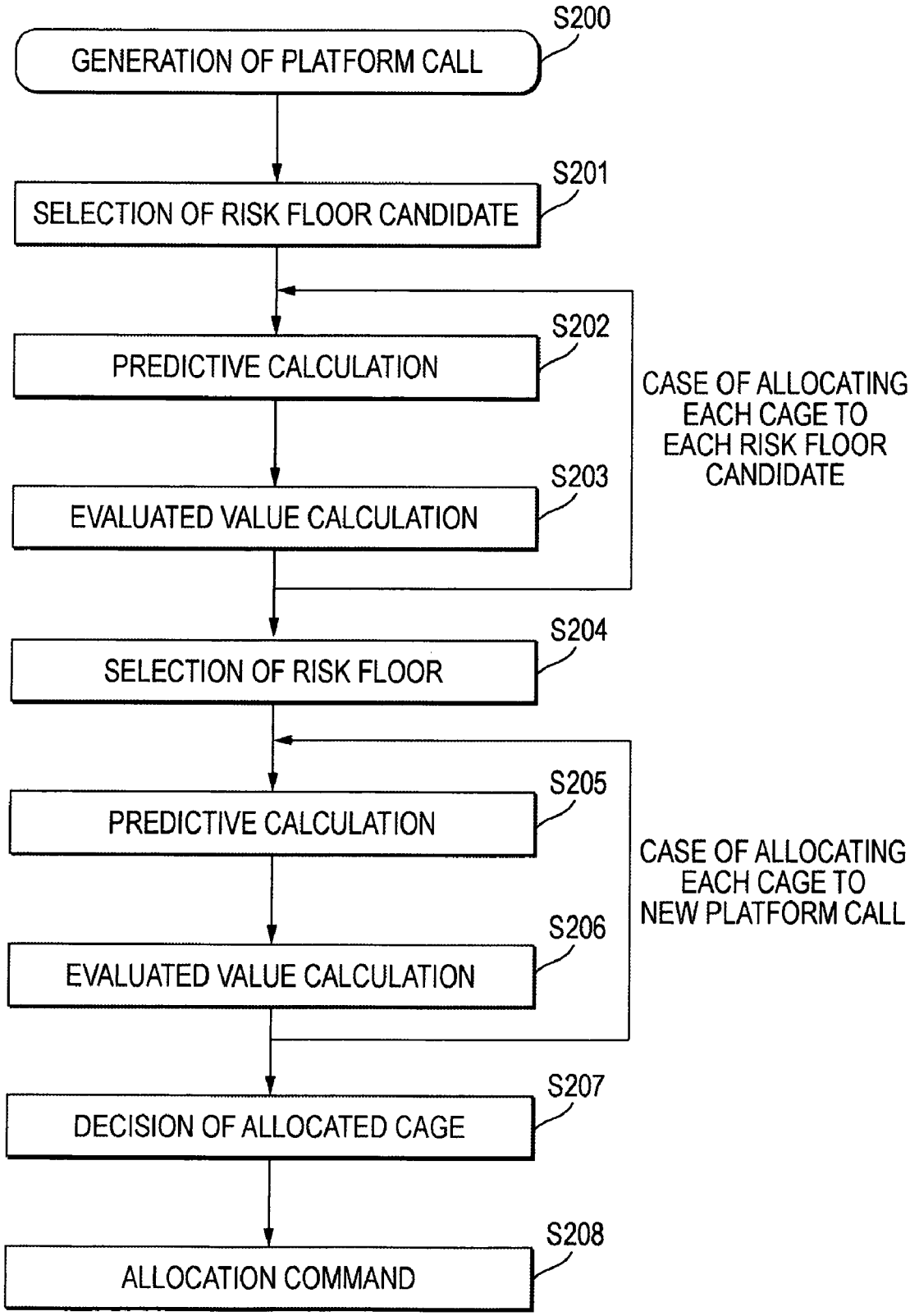
[FIG. 2]
Figure 3:
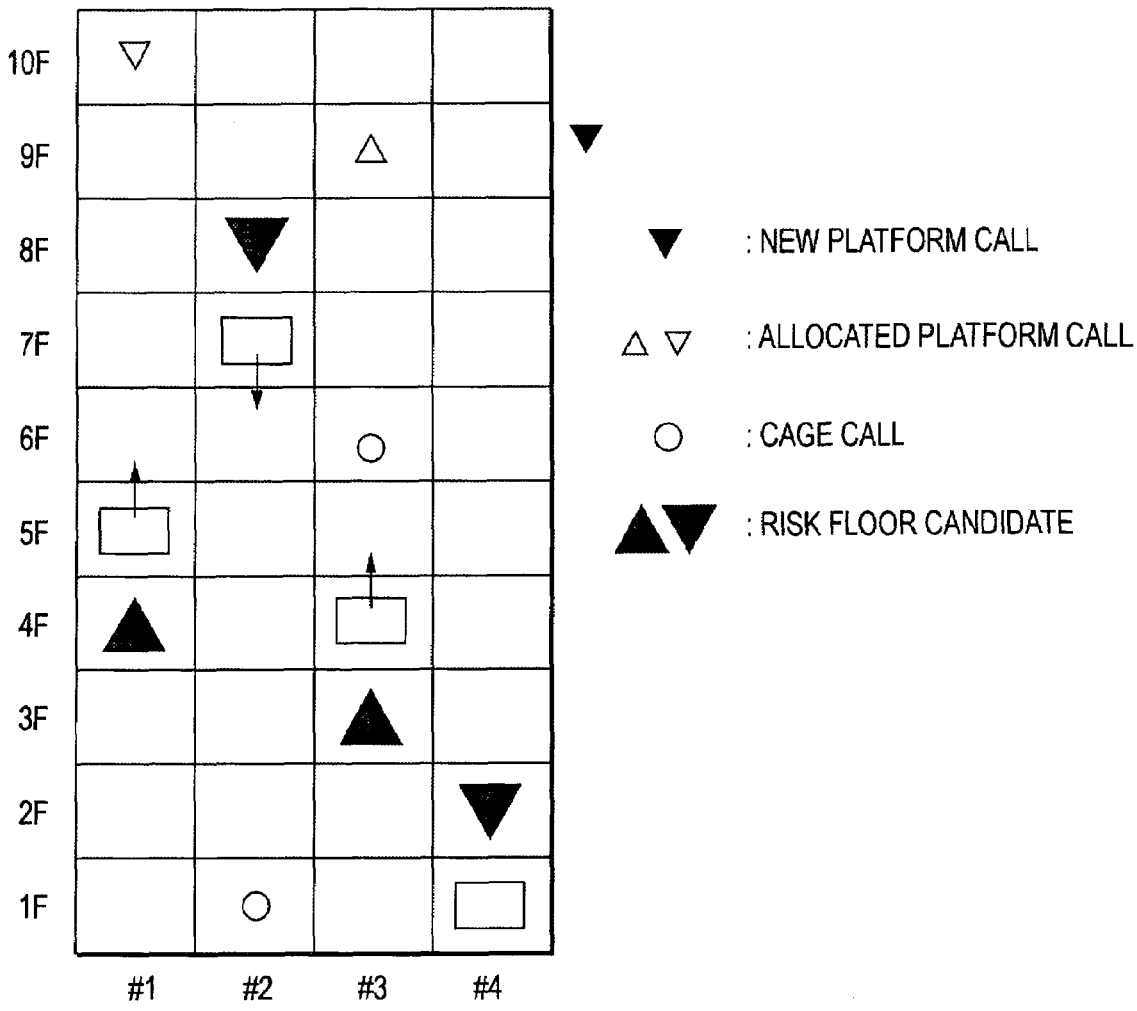
[FIG. 3]
Figure 4:
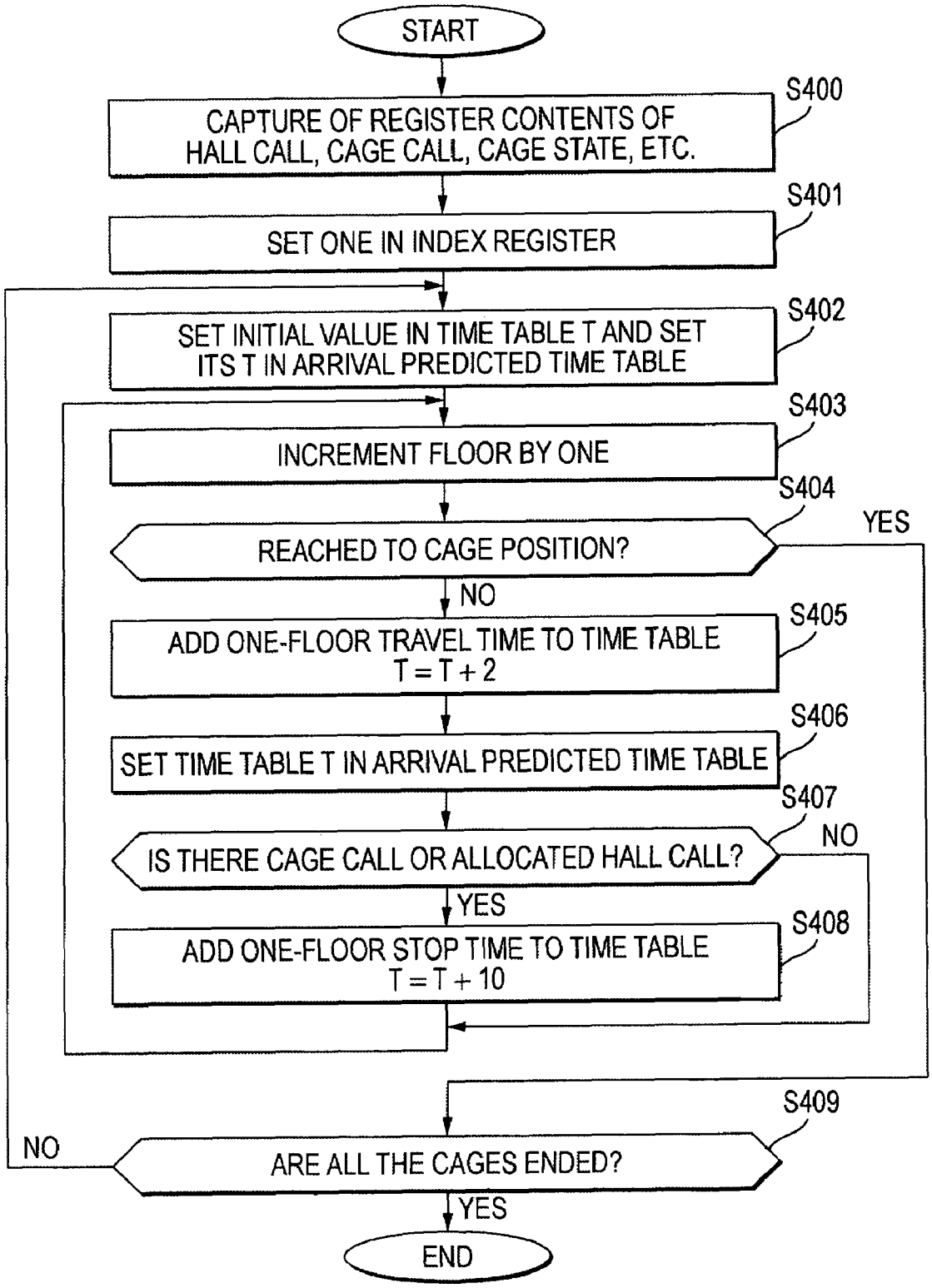
[FIG. 4]

The invention claimed is:

1. An elevator control method for controlling plural juxtaposed elevators working between many floors, characterized by including:

a step in which when a platform call is newly generated, risk floor selection means selects at least one of the risk floors having a high probability that a long wait occurs from among floors on which a platform call is not generated, a step of assuming that along with the newly generated platform call a platform call is generated on the selected risk floor and making allocation evaluation of the cases of allocating respective elevators to render services to these calls, a step in which allocation means decides an elevator to respond to the new platform call based on the allocation evaluation result, and a step in which operation control means controls the operation of the plural elevators based on the decision.

2. An elevator control method for controlling plural juxtaposed elevators working between many floors, characterized by including:

a step of, when a platform call is newly generated, selecting the farthest risk floor candidate for each of the elevators to reach from its moving direction and position at the point of time when the platform call is newly generated from among floors on which a platform call is not generated, a step of assuming that a platform call is generated on the selected risk floor and doing arrival predictive calculation on the case of respectively allocating elevators to render services to these calls, a step of doing evaluated value calculation based on the arrival predictive calculation result, a step of selecting a risk floor having the highest possibility of causing a long wait based on the evaluated value calculation result, a step of doing evaluation calculation and arrival predictive calculation on the case of allocating the each elevator to the new platform call, a step of deciding an elevator to be allocated to the new platform call based on the evaluation calculation result, and a step of controlling the operation of the plural elevators based on the decision.

3. An elevator control apparatus comprising plural respective elevator box control devices for respectively controlling plural juxtaposed elevators working between many floors and a group management control device for managing and controlling the plural respective elevator box control devices, characterized in that the group management control device comprises:

risk floor selection means for selecting at least one of the risk floors having a high probability that a long wait occurs from among floors on which a platform call is not generated when a platform call is newly generated, allocation evaluation means for assuming that along with the newly generated platform call a platform call is generated on the risk floor and making allocation evaluation on the case of respectively allocating elevators to render services to these calls, allocation means for deciding an elevator to respond to the new platform call based on the evaluation result of the allocation evaluation means, and operation control means for controlling the operation of the plural elevators by managing and controlling the plural respective elevator box control devices based on the allocation decision of the allocation means.

4. An elevator control apparatus as claimed in claim 3, characterized in that the risk floor selection means selects the farthest floor for each of the elevators to reach from its movement direction and a position at the point of time when a platform call is newly generated as the risk floor.

5. An elevator control apparatus comprising plural respective elevator box control devices for respectively controlling plural juxtaposed elevators working between many floors and a group management control device for managing and controlling the plural respective elevator box control devices, characterized in that the group management control device comprises:

risk floor selection means for selecting at least one of the risk floors having a high probability that a long wait occurs from among floors on which a platform call is not generated when a platform call is newly generated, a step of assuming that along with the newly generated platform call a platform call is generated on the selected risk floor and doing arrival predictive calculation on the case of respectively allocating elevators to render services to these calls, allocation evaluation means for making allocation evaluation on the cases of allocating respective elevators to render services to these calls based on the arrival predictive calculation result, allocation means for deciding an elevator to respond to the new platform call based on the evaluation result of the allocation evaluation means, and operation control means for controlling the operation of the plural elevators by managing and controlling the plural respective elevator box control devices based on the allocation decision of the allocation means.

* * * * *